US006866904B2

(12) United States Patent
Nellis et al.

(10) Patent No.: US 6,866,904 B2
(45) Date of Patent: Mar. 15, 2005

(54) LAMINATE MATERIAL WITH HEAT ACTIVATABLE LAYER

(75) Inventors: James A. Nellis, Phelps, NY (US); William L. Quartz, Pulaski, NY (US)

(73) Assignee: Felix Schoeller Technical Papers, Inc., Pulaski, NY (US)

( * ) Notice: Subject to any disclaimer, the term of this patent is extended or adjusted under 35 U.S.C. 154(b) by 121 days.

(21) Appl. No.: 10/440,614

(22) Filed: May 19, 2003

(65) Prior Publication Data

US 2003/0198760 A1 Oct. 23, 2003

Related U.S. Application Data

(63) Continuation-in-part of application No. 09/564,442, filed on May 4, 2000, now Pat. No. 6,572,953.

(51) Int. Cl.[7] ..... B41M 5/40

(52) U.S. Cl. ..... 428/32.87; 428/32.6; 428/423.1; 428/500

(58) Field of Search ..... 428/32.6, 32.87, 428/423.1, 500

(56) References Cited

U.S. PATENT DOCUMENTS 5,981,045 A 11/1999 Kuwabara et al.
6,004,718 A 12/1999 Shinohara
6,037,050 A * 3/2000 Saito et al. ..... 428/32.26
6,146,712 A 11/2000 Maeda et al.
6,200,668 B1 * 3/2001 Kronzer ..... 428/32.77
6,391,428 B1 5/2002 Ueno et al.
6,572,953 B1 * 6/2003 Quartz ..... 428/32.12
6,610,388 B2 * 8/2003 Xing et al. ..... 428/215
2002/0081420 A1 * 6/2002 Kronzer ..... 428/195
2003/0064201 A1 * 4/2003 Xing et al. ..... 428/195

* cited by examiner

*Primary Examiner*—B. Shewareged
(74) *Attorney, Agent, or Firm*—Cook, Alex, McFarron, Manzo, Cummings & Mehler, Ltd.

(57) ABSTRACT

A heat activatable printable material for the ink-jet printing process comprising a support and a heat-activatable polymer layer. The polymers of the polymer layer is a mixture of nonionic water soluble polyethylene oxide polymers with the general formula $H—[—O—CH_2—CH_2—]_nOH$, and an aliphatic polyester type polyurethane resin. The polymer layer is ink-jet printed and heat activated to adhere to a substrate with the support remaining on the polymer layer after adhesion of the polymer layer to the substrate.

31 Claims, No Drawings

LAMINATE MATERIAL WITH HEAT ACTIVATABLE LAYER

RELATED APPLICATION

This application is a continuation-in-part of application Ser. No. 09/564,442, filed May 4, 2000 now U.S. Pat. No. 6,572,953.

BACKGROUND AND SUMMARY OF THE INVENTION

This invention relates to an ink-jet printable laminate material having a heat-activatable adhesive layer.

Laminate transfer materials have been available for many years for the decoration of goods. Typically they comprise a polymeric or wax film which is formed on a support. An image is printed on the film and subsequently the film is transferred from the support to a substrate usually by applying pressure or heat to the back of the support, and the support is peeled or otherwise removed from the film after transfer.

FR 2 715 607 B1 describes a method for decorating a substrate with an image which, at first, has been printed on a transfer material. A digital image from a conventional video camera is printed using an ink-jet printer onto the transfer material which comprises a plastic support and a heat sensitive adhesive coating onto which the ink is printed. The printed side of the transfer material is placed in contact with the substrate and heat is applied to activate the coating. The plastic support can be removed once the adhesion between the coating and the substrate is greater than that between the coating and the plastic support. FR 2 715 607 does not disclose the composition of the coating which accepts the printing ink. However, non-heat-sealable coatings are essentially continuous films deposited from a polymer solution in an organic solvent or water, or from a dispersion of a polymer in water with emulsifiers.

WO 98/35840 describes a transfer film for transferring an ink comprising at least one liquid component, the film comprising a porous matrix of particles of a heat activatable adhesive bound together by an absorber, the absorber being at least partly soluble in the liquid component within the porous matrix, and the absorber preferably being within the pores of the porous matrix. The absorber has the double function of binding the matrix of heat activatable adhesive and at least partially absorbing the liquid component of the ink.

The absorber is a water soluble or hydrophilic absorber, i.e. an acrylate copolymer, a cellulose ether and/or a polyvinyl pyrrolidone. However, the printed image on the transfer material of WO 98/35840 shows a grainy appearance.

It is therefore an object of this invention to provide an improved image laminate material which does not show the above-mentioned disadvantages. The improved printable material shall provide high color densities, even image quality, short drying time and, in particular, good adhesion on the permanent substrate.

Copending U.S. application Ser. No. 09/564,442, filed May 4, 2000, of which this is a continuation-in-part and which is incorporated herein by reference, discloses a transfer material for the ink-jet printing process comprising a support and a heat-activatable polymer layer wherein the polymer of the polymer layer is a mixture of nonionic water soluble polyethylene oxide polymers with the general formula $H—[—O—CH_2—CH_2—]_nOH$, and wherein the degree of polymerization n is in the range of 1,000 to 200,000. That transfer material does not show the above-mentioned disadvantages and does provide high color densities, even image quality, short drying time and, in particular, good adhesion on the permanent carrier or substrate. However, in that transfer material once the polymer layer with the printing thereon has been applied to the substrate, the support is peeled away.

It is therefore a further object of this invention to provide an improved image laminate material which like the transfer material last described also does not show the above-mentioned disadvantages, does provide improved printable material with high color densities, even image quality, short drying time and, in particular, good adhesion on the permanent carrier or substrate.

It is also an object of this invention to provide an improved image laminate material in which the ink-jet printed material may be adhered to the substrate but the polymer support material may be left adhered to that material as a coating rather than peeled away as in the last mentioned transfer material.

DESCRIPTION OF THE PREFERRED EMBODIMENTS

These objects are achieved by a printable laminate material comprising a support and a heat-activatable polymer layer which is a mixture of two thermoplastic polymers. One polymer of the polymer layer is a mixture of nonionic water-soluble polyalkylene oxide polymers with the general formula $$H—[—O—CH_2—CH_2—]_nOH,$$

wherein the degree of polymerization n is in the range of 1,000 to 200,000, preferably about 80,000 to 130,000, more preferably about 90,000 to 110,000, and most preferably about 95,000 to 105,000.

The polyalkylene oxide may be polymethylene oxide, polyethylene oxide or polypropylene oxide, but polyethylene oxide is preferred.

The other thermoplastic polymer in the polymer layer is an aliphatic polyester type polyurethane resin which preferably has a degree of polymerization/molecular weight n in the range of about 40,000 to 80,000, and in a most preferred embodiment, of about 55,000 to 65,000. The softening point of the polyurethane resin is in the range of about 50 to 70° C., and preferably about 53 to 65° C.

The amount of polyalkylene oxide polymer in the polymer layer is preferably about 40–70 weight percent of the total polymers in the polymer layer.

The amount of polyurethane polymer in the polymer layer is preferably about 35–60 weight percent of the total polymers in the polymer layer.

The polymer layer may also include polyvinyl alcohol in the amount of about 1–10 weight percent of the total polymers in the polymer layer. The polyvinyl alcohol results in improved ink absorption and a reduction in bleed.

It was found that the polymers used in the polymer layer of the present invention can serve the dual function of an absorber for the ink and as a heat activatable adhesive. It is assumed that this fact has a profound effect on the print quality of the image. The coating comprising the polymers is applied in the form of a homogeneous solution of polymers, whereas the transfer film of WO 98/35840 is obtained by applying a non-homogenous dispersion of two non-miscible polymers. In the prior art document only the absorber polymers are capable of absorbing the ink and the colorant, while the heat-activatable adhesive will not. The laminate material of the invention results in an improved image quality and improved optical density of the print.

Although not necessary for the purpose of the present invention, the polymer layer may contain additional polymers. Although the polymer layer need not contain pigments, it may contain small amounts of pigments such as silica, alumina, aluminum hydroxide, calcium and/or magnesium containing compounds.

The polymer layer also may contain dye fixing agents such as quaternary polyammonium salts, cationic polyamines, cationic polyacryl amides or cationic polyethylene amides. Particularly preferred are polyquaternary amines. The amount of the dye fixing agent should not exceed 5% by weight, based on the weight of the dry layer. Preferably, the amount of the dye fixing agent is in the range of 0.1 to 3.0% by weight, based on the dry weight of the layer.

The polymer layer may also contain additional additives such as wetting agents, dispersing agents or colorants.

Resin coated papers or plastic films are suitable supports. The thickness of the support generally is 1 to 500 $\mu$m, preferably 5 to 200 $\mu$m. Examples of resin coated papers include papers which are coated with polyolefins or polyesters. Suitable plastic films for the purposes of the present invention include, for example, polyester films or polypropylene films. Additionally, films made of polycarbonates, polyamides, polystyrene and cellulosic esters and metals are suited for the purposes of the present invention.

The coating weight (dry) of the polymer layer on the support may be between about 15–50 g/m$^2$ with about 30 g/m$^2$ preferred.

The thickness of the polymer layer is preferably between about 20–50 $\mu$m.

The heat activation temperature is preferably between about 90° C.–135° C.

The advantage of the heat activatable layer of the present invention is its capability to absorb ink and to provide high color density and to act, after heating, as an adhesive layer for the material to be laminated onto the final substrate. The final substrate to which the polymer layer is applied may be a wide range of materials including plastic, glass, wood or metallic. After ink-jet printing, the material undergoes a heat treatment which activates the polymer layer to develop the adhesive properties. Once the polymer layer has been applied to the substrate, the support upon which the polymer layer was originally coated is retained and acts as a cover layer for the printed polymer layer in the present invention.

The following examples should further explain the invention.

EXAMPLE 1

Onto a polyester film with a thickness of 70 $\mu$m a heat activatable polymer layer of the following composition is applied and then dried:

| | |
|---|---|
| Polyurethane | 60 weight percent |
| Polyethylene oxide | 40 weight percent |
| Wetting agent | 0.2 weight percent |

These were mixed with enough water to facilitate the application to the polyester film.

All indications of weight percent refer to the total polymers in the polymer layer. The coating weight of the polymer layer after drying is 30 g/m$^2$ and the thickness is 38 $\mu$m.

EXAMPLE 2

Onto a polyester film with a thickness of 70 $\mu$m a heat activatable polymer layer of the following composition is applied and then dried:

| | |
|---|---|
| Polyurethane | 40 weight percent |
| Polyethylene oxide | 50 weight percent |
| Polyvinyl alcohol | 10 weight percent |
| Wetting agent | 0.2 weight percent |

These were mixed with enough water to facilitate the application to the polyester film.

All indications of weight percent refer to the total polymers in the polymer layer. The coating weight of the polymer layer after drying is 30 g/m$^2$, and the thickness is 38 $\mu$m.

EXAMPLE 3

Onto a polyester film with a thickness of 70 $\mu$m a heat activatable polymer layer of the following composition is applied and then dried:

| | |
|---|---|
| Polyurethane | 30 weight percent |
| Polyethylene oxide | 70 weight percent |
| Wetting agent | 0.2 weight percent |

These were mixed with enough water to facilitate the application to the polyester film.

All indications of weight percent refer to total polymers in the polymer layer. The coating weight of the polymer layer after drying is 30 g/m$^2$ and the thickness is 38 $\mu$m.

In Examples 1–3, the polyurethane is Sancure 2104 from Noveon, the polyethylene oxide is Polyox WSR10 from Dow; the polyvinyl alcohol is Cevol 203 from Celanese Chemicals, and the wetting agent is Zonyl FSN from du Pont.

The samples of Examples 1 to 3 are printed on with a Hewlett Packard HP 5000 wide format ink-jet printer with a test image including the colors black, cyan, magenta and yellow. Subsequently, the resulting laminate materials are applied at a temperature of 105° C. on a white polyethylene coated paper substrate. Thus, all images have the same substrate. The color density, image quality, drying time and adhesion of the resulting materials are tested.

Color Density

Color density is determined with a Gretag Densitometer Type 186 D with the colors black, cyan, magenta and yellow.

Image Quality

The image quality of the color application is assessed visually at the black areas of the test image and is marked 1 to 5 (very good to very bad).

Drying

The time is measured from application of the ink until the time that smudge of the ink was no longer possible.

TABLE 1

| Example | Dry time | Image Quality | Adhesion |
|---|---|---|---|
| 1 | 10 min. | 3 | 1 |
| 2 | 3 min | 2 | 2 |
| 3 | 2.5 min | 1 | 3 |

TABLE 2

| | Color density | | | |
|---|---|---|---|---|
| Example | Black | Cyan | Magenta | Yellow |
| 1 | 2.2 | 1.9 | 1.6 | 1.35 |
| 2 | 2.13 | 1.78 | 1.63 | 1.3 |
| 3 | 2 | 1.54 | 1.55 | 1.1 |

The examples show that the polymer layer of the present invention provides a good to excellent image laminate material with excellent color densities, and good to excellent image quality and adhesion.

What we claim is:

1. A heat activatable ink-jet printable material comprising a support and a heat-activatable ink-jet printable polymer layer wherein the polymer of the polymer layer is a mixture of (i) about 40 to 70 weight percent based upon the total polymers in the polymer layer of nonionic water-soluble polyalkylene oxide polymer having the general formula $H—[—O—CH_2—CH_2—]_nOH$ wherein the degree of polymerization n is in the range of about 1,000 to 200,000; and (ii) 35 to 60 weight percent based upon the total polymers in the polymer layer of at least one additional thermoplastic polyurethane polymer having a softening point of about 50 to 70° C.; and wherein said polymer layer is located on and remains on the support after heat activation.

2. The heat activatable ink-jet printable material of claim 1, wherein n is from about 80,000 to 130,000.

3. The heat activatable ink-jet printable material of claim 2, wherein n is from about 95,000 to 105,000.

4. The heat activatable ink-jet printable material of claim 1, wherein the non-ionic water soluble polyalkylene oxide is polyethylene oxide.

5. The heat activatable ink-jet printable material of claim 4, wherein the additional thermoplastic polymer is an aliphatic polyester type polyurethane resin having a molecular weight in the range of from about 40,000 to 80,000.

6. The heat activatable ink-jet printable material of claim 1, wherein the additional thermoplastic polymer is an aliphatic polyester type polyurethane resin having a molecular weight in the range of from about 40,000 to 80,000.

7. The heat activatable ink-jet printable material of claim 1, wherein the additional polymer has a softening point of about 53 to 65° C.

8. The heat activatable ink-jet printable material of claim 1, wherein the additional thermoplastic polymer has a molecular weight in the range of from about 55,000 to 65,000.

9. The heat activatable ink-jet printable material of claim 1, wherein the polymer layer includes a dye fixing agent.

10. The heat activatable ink-jet printable material of claim 1, wherein the support is a plastic film.

11. The heat activatable ink-jet printable material of claim 10, wherein the support is polyester.

12. The heat activatable ink-jet printable material of claim 1, wherein the polymer layer also includes polyvinyl alcohol.

13. The heat activatable ink-jet printable material of claim 12, wherein the polyvinyl alcohol is present in the amount of about 1–10 weight percent based on the total polymers in the polymer layer.

14. The heat activatable ink-jet printable material of claim 4, wherein n is from about 80,000–130,000; the additional thermoplastic polymer is an aliphatic polyester type polyurethane resin having a molecular weight in the range of about 40,000 to 80,000, and a softening point of about 53 to 65° C.; and wherein the support is a plastic film.

15. The heat activatable ink-jet printable material of claim 1, wherein the polymer layer also includes polyvinyl alcohol in the amount of about 1–10 weight percent based on the total polymers in the polymer layer.

16. A method of applying an ink-jet printed material to a substrate comprising:

providing an ink jet printable material comprising a support and a heat-activatable ink-jet printable polymer layer wherein the polymer of the polymer layer is a mixture of (i) about 40 to 70 weight percent based upon the total polymers in the polymer layer of nonionic water-soluble polyalkylene oxide polymer having the general formula $H—[—O—CH_2—CH_2—]_nOH$ wherein the degree of polymerization n is in the range of about 1,000 to 200,000; and (ii) 35 to 60 weight percent based upon the total polymers in the polymer layer of at least one additional thermoplastic polyurethane polymer having a softening point of about 50 to 70° C.;

ink-jet printing the polymer layer;

applying the printed polymer layer to a substrate;

heat activating the polymer layer to adhere the polymer layer to the substrate; and retaining the support on the polymer layer to cover the polymer layer after it is adhered to the substrate.

17. The method of claim 16, wherein n is from about 80,000 to 130,000.

18. The method of claim 17, wherein n is from about 95,000 to 105,000.

19. The method of claim 16, wherein the non-ionic water soluble polyalkylene oxide is polyethylene oxide.

20. The method of claim 19, wherein the additional thermoplastic polymer is an aliphatic polyester type polyurethane resin having a molecular weight in the range of from about 40,000 to 80,000.

21. The method of claim 16, wherein the additional thermoplastic polymer is an aliphatic polyester type polyurethane resin having a molecular weight in the range of from about 40,000 to 80,000.

22. The method of claim 16, wherein the additional polymer has a softening point of about 53 to 65° C.

23. The method of claim 16, wherein the additional thermoplastic polymer has a molecular weight in the range of from about 55,000 to 65,000.

24. The method of claim 16, wherein the polymer layer includes a dye fixing agent.

25. The method of claim 16, wherein the support is a plastic film.

26. The method of claim 25, wherein the support is polyester.

27. The method of claim 16, wherein the polymer layer also includes polyvinyl alcohol.

28. The method of claim 16, wherein the polyvinyl alcohol is present in the amount of about 1–10 weight percent based on the total polymers in the polymer layer.

29. The method of claim 19, wherein n is from about 80,000–130,000; the additional thermoplastic polymer is an aliphatic polyester type polyurethane resin having a molecular weight in the range of about 40,000 to 80,000, and a softening point of about 53 to 65° C.; and wherein the support is a plastic film.

30. The method of claim 29, wherein the polymer layer also includes polyvinyl alcohol in the amount of about 1–10 weight percent based on the total polymers in the polymer layer.

31. The method of claim 16, wherein the heat activation temperature is between about 90° C. to 135° C.

* * * * *